US006595355B1

(12) United States Patent
Hooper

(10) Patent No.: US 6,595,355 B1
(45) Date of Patent: Jul. 22, 2003

(54) POINT-OF-SALE HANGER FOR FOOTWEAR

(75) Inventor: Terrence Hooper, Newtown, PA (US)

(73) Assignee: E.S. Originals, Inc., New York, NY (US)

( * ) Notice: Subject to any disclaimer, the term of this patent is extended or adjusted under 35 U.S.C. 154(b) by 4 days.

(21) Appl. No.: 10/034,516

(22) Filed: Dec. 28, 2001

(51) Int. Cl.[7] ..... B65D 75/00
(52) U.S. Cl. ..... 206/292; 206/461; 206/806
(58) Field of Search ..... 206/282, 289, 206/290, 292, 294, 296, 298, 461, 476, 477, 806; 223/85

(56) References Cited

U.S. PATENT DOCUMENTS 5,282,553 A * 2/1994 Ibled ..... 223/85
5,906,350 A * 5/1999 Kao ..... 248/688
6,481,182 B1 * 11/2002 Fuller ..... 53/399

* cited by examiner

*Primary Examiner*—Jacob K. Ackun
(74) *Attorney, Agent, or Firm*—Kirschstein, et al.

(57) ABSTRACT

A point-of-sale hanger for footwear includes a bracket having a rear part inserted into a header, and a front part having a pair of shoe holders arranged in a mirror symmetrical relationship. The hanger has a reinforced hook-shaped cutout by which it is suspended from a support rod.

20 Claims, 5 Drawing Sheets

10
14
16
18
20
22
24
26
30
32
34
36
38
40
42
44
46
48
50
56
58
3

POINT-OF-SALE HANGER FOR FOOTWEAR

BACKGROUND OF THE INVENTION

1. Field of the Invention

The present invention generally relates to displaying and selling shoes without using shoeboxes and, more particularly, to hangers for holding shoes upright for display and sales purposes.

2. Description of the Related Art

Footwear is traditionally packed and transported in shoeboxes. For display purposes, a cover of the shoebox is often removed to enable a customer to view shoes packed therein. More often, a representative shoe is removed from the shoebox and placed on a table or rack for customer inspection. The representative shoe is virtually never the same as the shoe ultimately purchased, typically because the representative shoe is the wrong size or color, or has been damaged during multiple customer handlings.

There are certain casual shoes, such as thongs, sandals, slippers, slides and mules, which are not packed in shoeboxes, typically for reasons of cost. Sometimes, a pair of such casual shoes is tethered together by a plastic tie, or is strapped onto a backing sheet, or is tethered to and dangles from a card. Such strapping and tethering techniques are more cost effective than using shoeboxes, but do not display the shoes in the best possible presentation.

It is also known to place a pair of shoes on a flat hanger that generally lies in a plane. However, the weight and physical size of the shoes tend to swing the hanger to a tilted position in which the shoes are not shown to their full advantage.

SUMMARY OF THE INVENTION

1. Objects of the Invention

Accordingly, it is a general object of this invention to attractively display and sell shoes without using shoeboxes.

More particularly, it is an object of the present invention to display casual shoes in an upright attitude.

Still another object of the present invention is to hang shoes from a support rod in a manner convenient for customer inspection and handling.

2. Features of the Invention

In keeping with the above objects and others which will become apparent hereafter, one feature of the present invention resides, briefly stated, in a point-of-sale hanger for footwear. The hanger includes a bracket having a front part, a rear part and a connecting part that extends along a longitudinal direction between, and interconnects, the front and rear parts. In the preferred embodiment, the rear part has a larger height than the front part, and is flat. The rear part has opposite surfaces, and is formed with a first cutout, preferably in the shape of a hook, that extends through the surfaces of the rear part.

The hanger further includes a header bearing information relating to the footwear, and having generally planar panel positions engaging the opposite surfaces of the rear part. Each panel portion has a second cutout of complementary contour to, and reinforcing, the first cutout. The mutually aligned cutouts are used to suspend the hanger on a support, such as a rod or peg. The header may be a single piece of folded sheet material.

The hanger yet further includes a pair of holders in a side-by-side relationship, preferably mirror symmetrical, on the front part, for holding the footwear for display. A display area may be provided on the front part between the holders. An adhesive decal bearing data relating to the footwear may be adhered to the display area. Each holder hooks onto or into a piece of the footwear. The footwear is mostly accommodated in the space between the front and rear parts.

The type of footwear dictates the form of the holder. Thus, each holder may bound a channel having an open upper end such that a toe post of a sandal or thong, or a strap of a slide, may be inserted through the upper end. Each holder may bound a channel having an open side end such that a loop attached to a slipper or boot may be slid onto each holder. Each holder may have an arched frame for insertion into a toe pouch to maintain the shape of the footwear.

For better support, a stiffening rib may extend between the front and rear parts, and a strengthening fin may be provided rearwardly of the rear part. A raised peripheral edge may be provided around the periphery of each holder and the central display area.

In accordance with this invention, footwear is displayed and sold on a hanger which holds the shoes upright and readily visible and accessible to the customer. Each shoe is securely held on, and removable from, the hanger. Information relating to the shoes is presented for ready reference. The hanger is strong enough to support heavy shoes.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
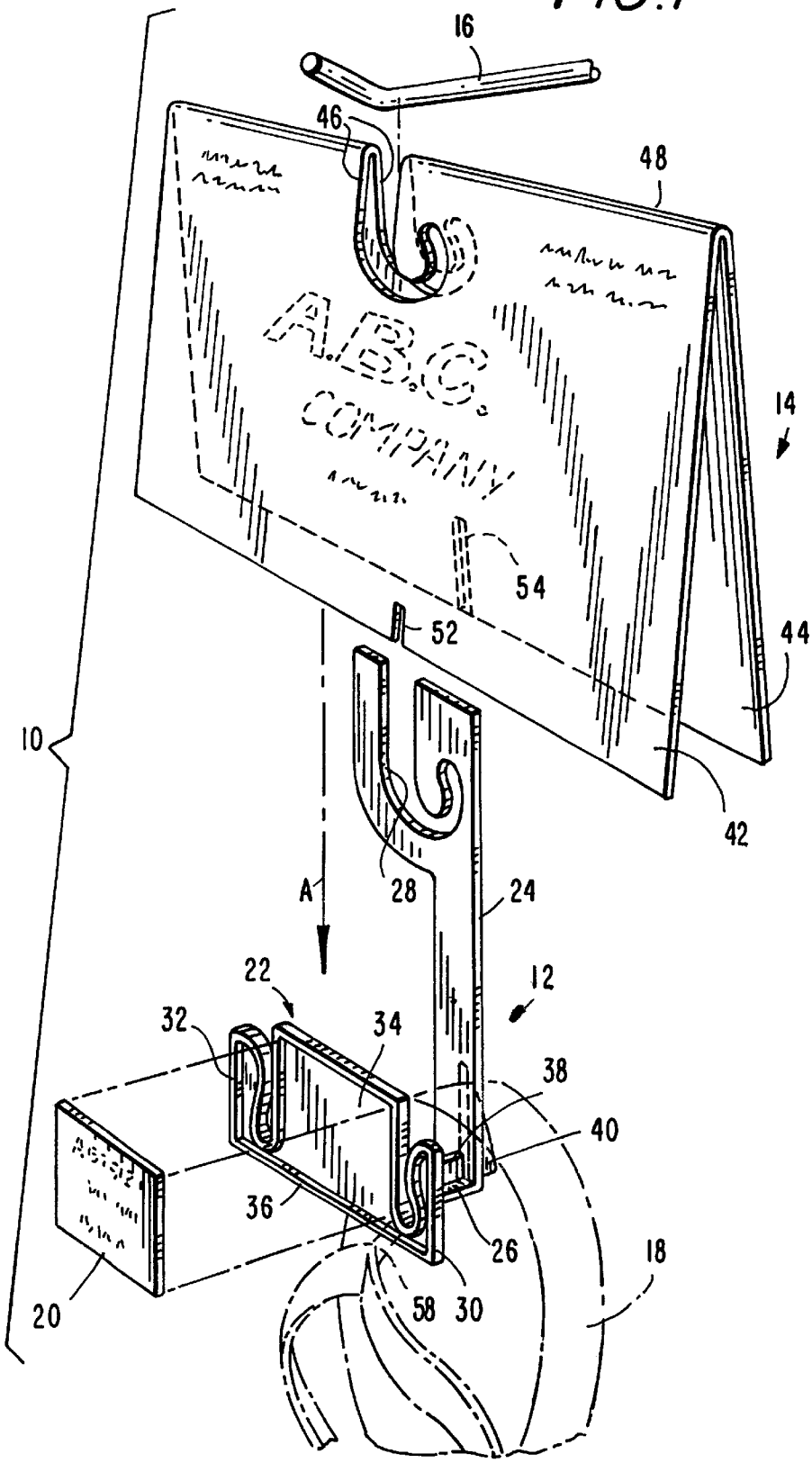
FIG. 1 is an exploded view of a first embodiment of a hanger according to this invention.
Figures 2, 3:
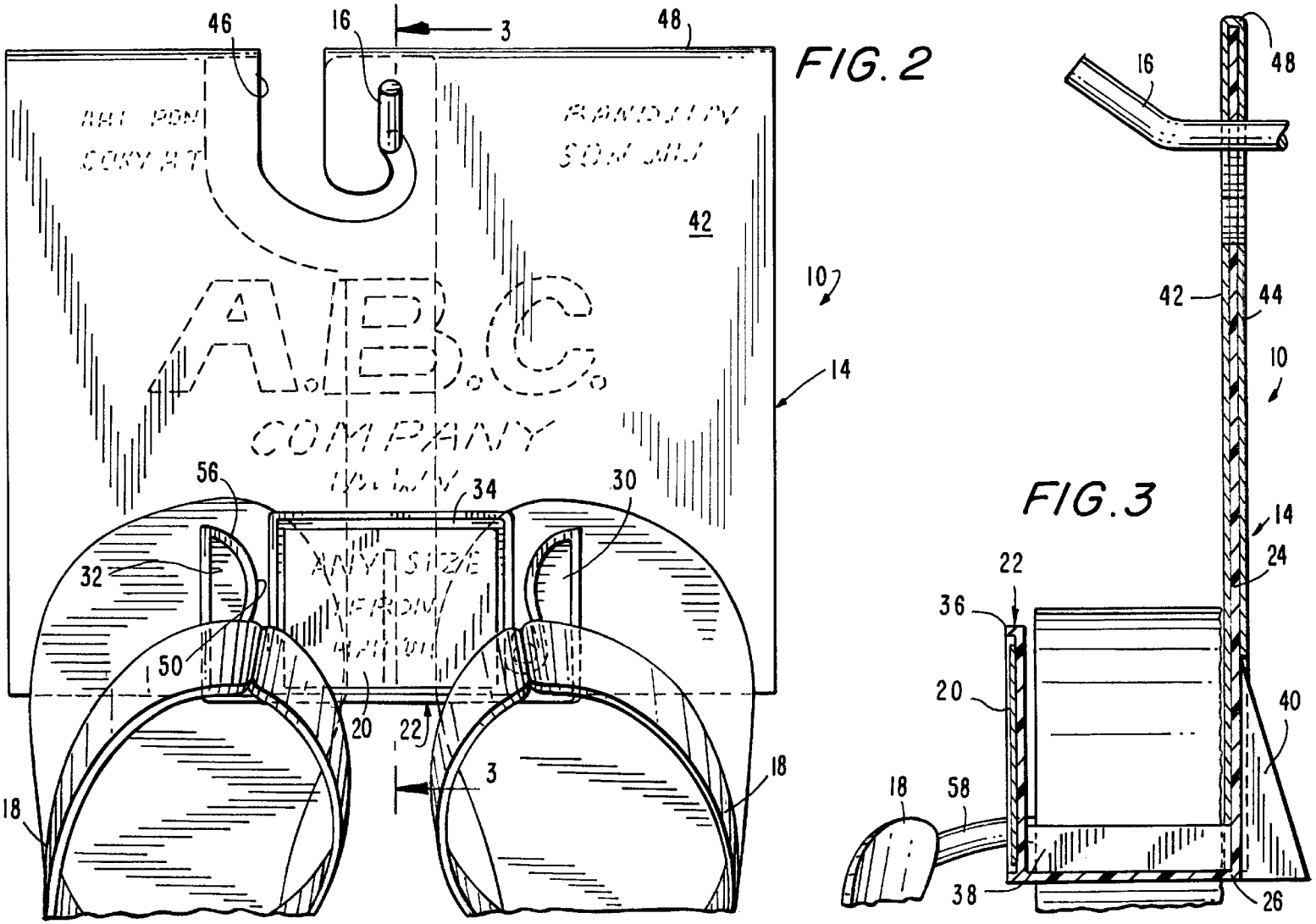
FIG. 2 is a broken-away front elevational view of the hanger embodiment of FIG. 1.
FIG. 3 is a sectional view taken on line 3—3 of FIG. 2.

Referring now to the drawings, reference numeral 10 in FIGS. 1–3 generally identifies a first embodiment of a point-of-sale hanger for footwear. Hanger 10 includes a bracket 12 and a header 14. The hanger 10 is intended to be suspended from a support 16, such as a rod or peg projecting from an upright board or wall. A pair of shoes, such as sandals or thongs 18, is hung from the bracket in a side-by-side, upright relationship. An adhesive decal 20 bearing data relating to the shoes, such as shoe size, is adhesively secured to the bracket. The header 14, likewise, bears information relating to the shoes, such as the manufacturer's name or shoe style.

Bracket 12 includes a front part 22, a rear part 24 spaced rearwardly away from the front part along a longitudinal direction, and a connecting part 26 extending along the longitudinal direction between, and interconnecting, the front and rear parts. The rear part 24 is flat, has opposite planar surfaces, and is formed with a first cutout 28 extending through the planar surfaces at an upper region of the rear part. The first cutout 28 has a hook shape and resembles the letter "J" as seen from behind the rear part. The height of the rear part 24 is substantially the same as the height of the header 14 as shown in FIGS. 2 and 3.

The front part 22 of the bracket includes a pair of shoe holders 30, 32 in a mirror symmetrical relationship, and a central display area 34 located between the holders 30, 32. A raised peripheral edge or rim 36 surrounds the holders and the display area and strengthens them. The decal 20 is mounted on the display area 34 and is located between portions of the rim 36 that serve to frame the decal. The front part lies essentially in a plane and has a height that is less than the height of the taller rear part, as shown in FIG. 3.

The connecting part 26 is flat and is connected to lower edges of the front and rear parts. A stiffening rib 38 extends between the front and rear parts in a plane perpendicular to the flat connecting part to stiffen and reinforce the latter. A strengthening fin 40 rearwardly of the rear part extends at least partly upwardly along the rear part to stiffen and reinforce the same. The bracket is preferably, but not necessarily, molded of a one-piece, synthetic plastic material.

The header 14 has generally planar panel portions 42, 44 engaging the opposite surfaces of the rear part 24, and bearing information relating to the footwear. Each panel portion has a second cutout 46 of complementary contour to the first cutout 28. In other words, each second cutout 46 also has a hook shape which, as seen from behind, resembles the letter "J". As shown, the header is a single piece of sheet material that is folded about fold line 48 to form the two panel portions 42, 44. Panel portion 42 has a short vertical slit 52 at its lower free edge. Panel portion 44 has a taller vertical slit 54 at its lower free edge. The header is constituted of a heavy duty paper.

To assemble the header on the bracket, the header is moved in the direction of arrow A in FIG. 1 such that the rear part 24 is inserted and sandwiched between the panel portions until the slit 52 receives the stiffening rib 38 and the slit 54 receives the fin 40. The slits serve to lock the panel portions in position tightly pressed against the opposite surfaces of the rear part. Adhesive may be applied on interior facing surfaces of the panel portions. In the assembled position shown in FIGS. 2 and 3, the first 28 and the second 46 cutouts are aligned. In effect, there are three juxtaposed cutouts, all of which tend to reinforce one another and serve as a strengthened hook from which the hanger can be reliably supported from the support 16.

Each shoe holder 30, 32 of FIG. 2 bounds a channel 50 having an open upper end 56. Channel 50 has a variable cross-section that converges from the upper end 56 to a waist of reduced cross-section and then diverges in a direction away from the waist to a closed bottom end of the channel. This type of shoe holder is especially good for holding shoes such as sandals or thongs that have a toe post 58 (see FIG. 3). The toe post is introduced to the channel 50 at the upper end 56 and then forcibly pulled down against the waist to deflect the latter out of the way until eventually clearing the waist and resting at the bottom end of the channel.

Figure 5:
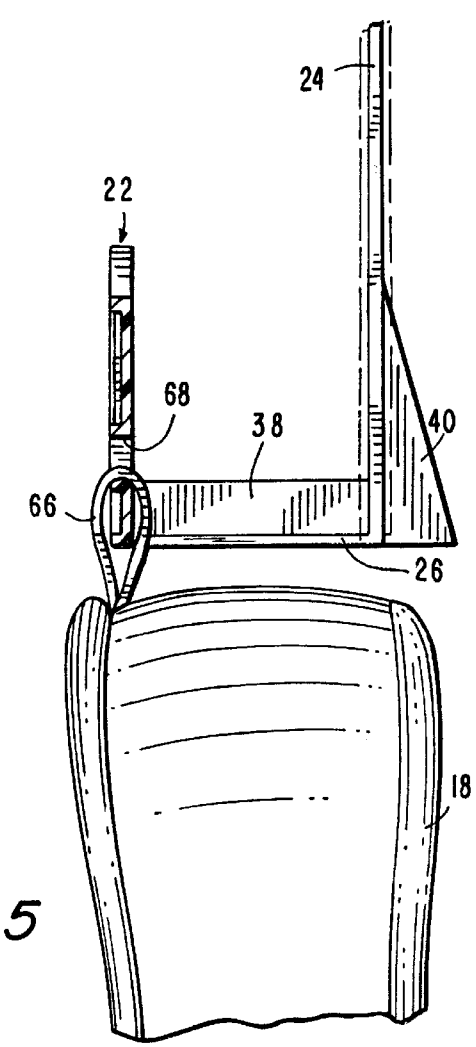
FIG. 5 is a sectional view taken on line 5—5 of FIG. 4.
Figure 4:
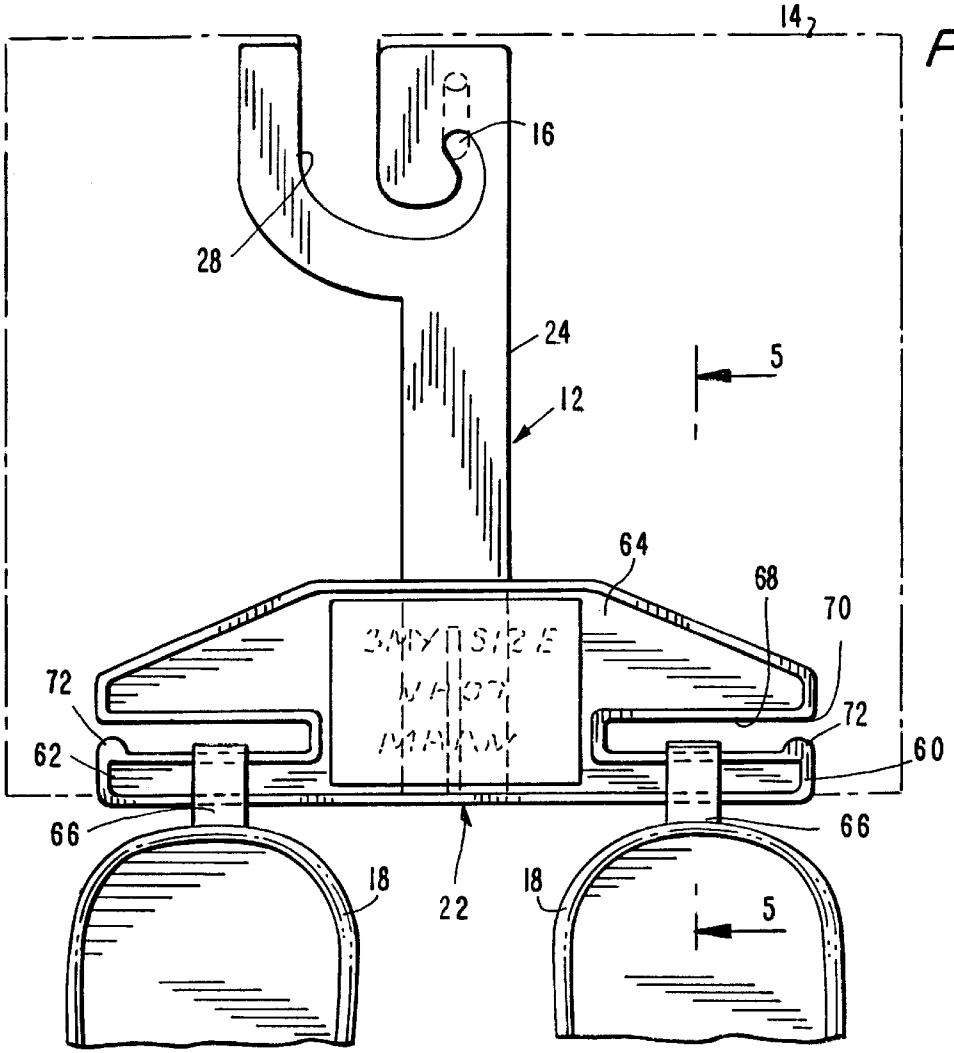
FIG. 4 is analogous to FIG. 2, but of a second hanger embodiment.

The second embodiment of FIGS. 4–5 is identical to the first, except that the front part has been modified to better hold a different type of shoe, in this case, a boot or slipper having a rear heel loop tab 66. The front part has a pair of mirror symmetrical shoe holders 60, 62 at opposite sides of a central display area 64. Each shoe holder 60, 62 of FIG. 4 bounds a channel 68 having an open side end 70. The cross-section of the channel 68 is uniform except at the side end 70 where a raised bump 72 is present.

This type of shoe holder is better suited for holding shoes with the aforementioned loop tab 66, because the respective holder 60, 62 is inserted through the loop tab until a convenient position along the length of the holder is reached. The bump 72 prevents the loop tab from inadvertently sliding off the holder.

Figure 7:
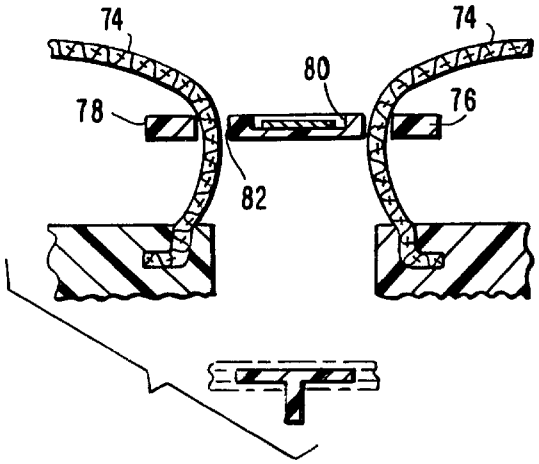
FIG. 7 is a sectional view taken on line 7—7 of FIG. 6.
Figure 6:
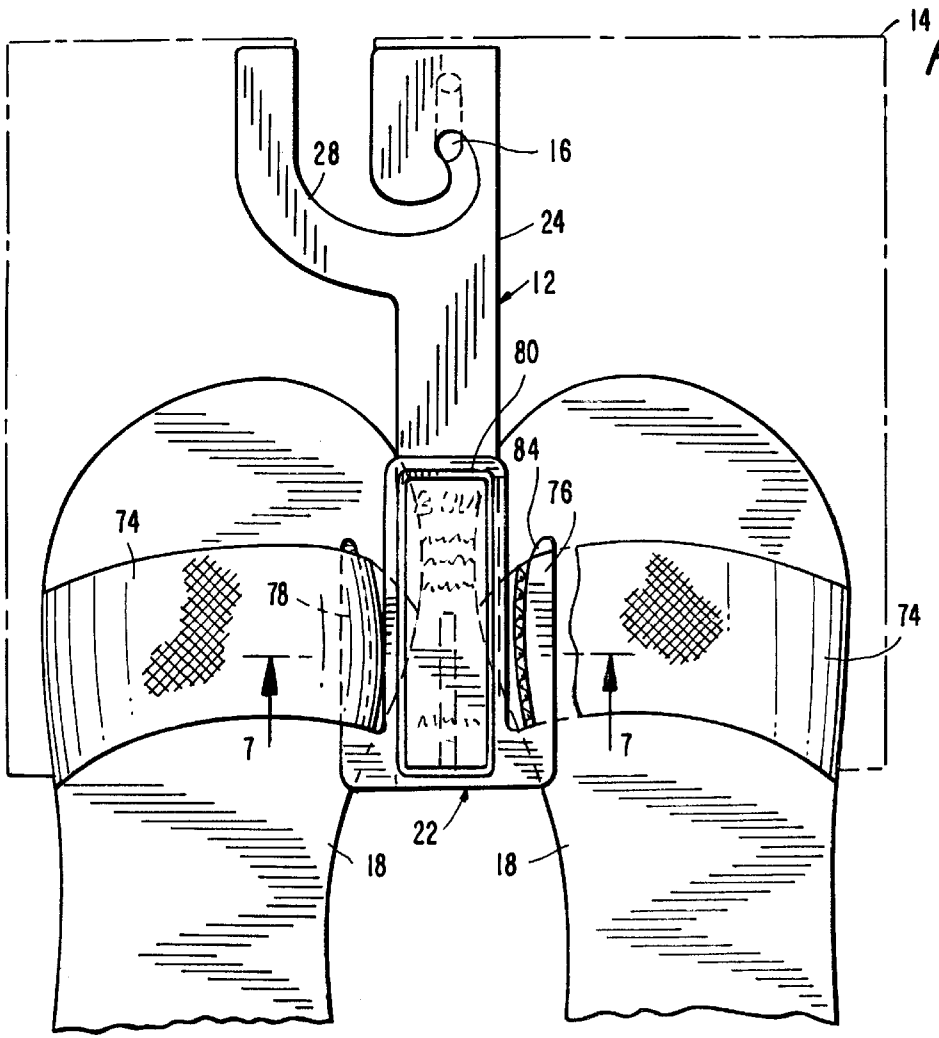
FIG. 6 is analogous to FIG. 4, but of a third hanger embodiment.

The third embodiment of FIGS. 6–7 is identical to the first, except that the front part has been modified to better hold a different type of shoe, in this case, a slide having a strap 74 that goes over the top of a user's foot when worn. The front part has a pair of mirror symmetrical shoe holders 76, 78 at opposite sides of a central display area 80. Each shoe holder 76, 78 of FIG. 6 bounds a channel 82 having an open upper end 84. Channel 82 has a variable cross-section that more gradually, as compared to the first embodiment, converges from the upper end 84 to a waist and then diverges. The strap 74 of this shoe style is inserted through the upper end 84 until a lower edge of the strap abuts against a closed bottom end of the channel 82.

Figure 9:
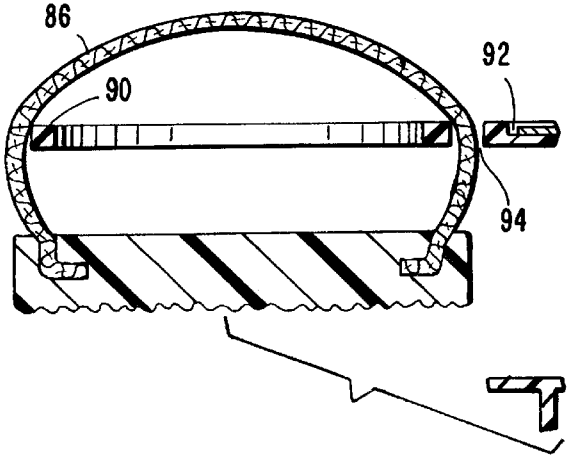
FIG. 9 is a sectional view taken on line 9—9 of FIG. 8.
Figure 8:
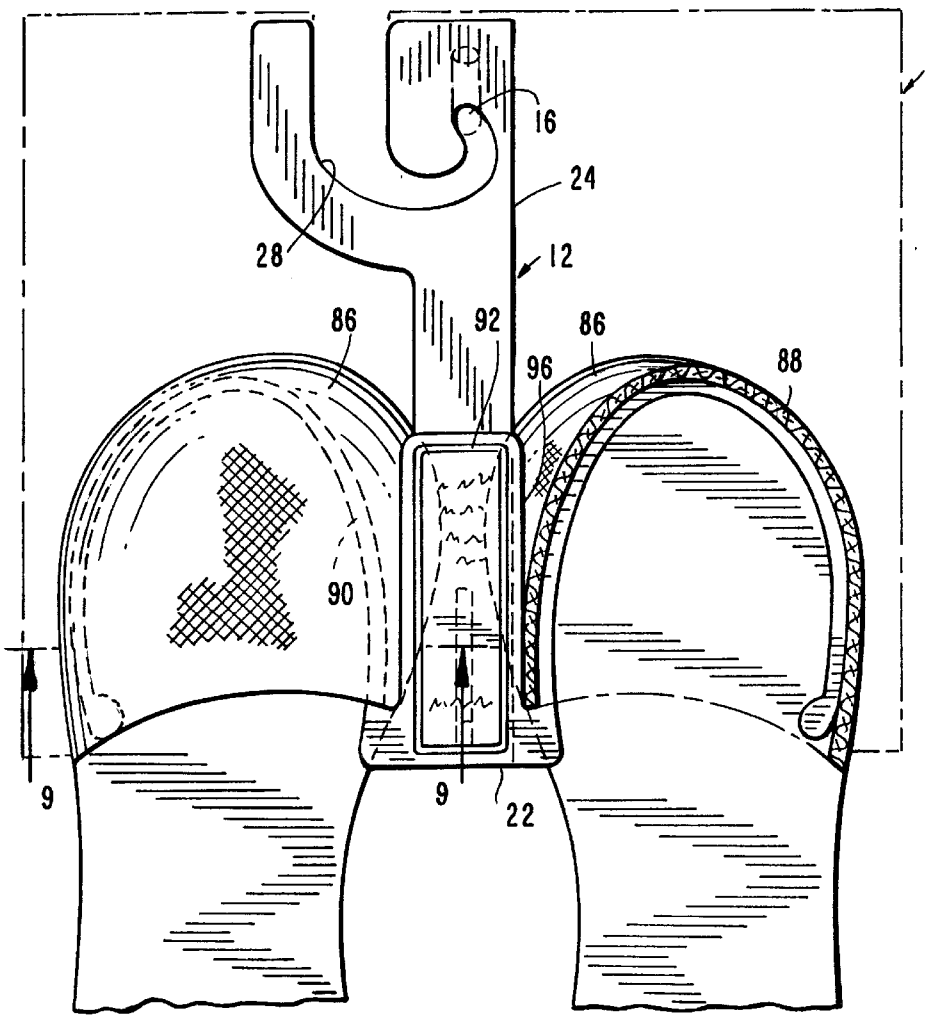
FIG. 8 is analogous to FIG. 6, but of a fourth hanger embodiment.

The fourth embodiment of FIGS. 8–9 is identical to the first, except that the front part has been modified to better hold a different type of shoe, in this case, a slipper or mule having a front closed toe pouch 86. The front part has a pair of mirror symmetrical shoe holders 88, 90 at opposite sides of a central display area 92. Each shoe holder 88, 90 of FIG. 8 has an arch shape and bounds a channel 94 having an open upper end 96. The cross-section of the channel 94 converges continuously from the open upper end 96 to the bottom end of the channel. The arch shape of each holder is inserted into the toe pouch 96 to maintain its shape.

In all of the disclosed embodiments, each pair of shoes is reliably held upright within ready access and visibility to a customer. The shoes are not held dangling in random positions from tethers.

It will be understood that each of the elements described above, or two or more together, also may find a useful application in other types of constructions differing from the types described above.

For example, the bracket need not be molded of a single piece of material, but could be constituted of discrete parts assembled together. The header need not be a single piece of material, but could also be constituted of discrete parts assembled together. The cutouts need not be configured with the illustrated hook-shaped configuration, but could be shaped with other configurations. For example, each cutout could be a simple circular hole, just to mention one possibility. The decal 20 is optional and could be eliminated. The central display area could be left empty, or could be provided with a molded-in design or relief.

While the invention has been illustrated and described as embodied in a point-of-sale hanger for footwear, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. A point-of-sale hanger for footwear, comprising:

a) a bracket having a front part, a rear part spaced away from the front part along a longitudinal direction, and a connecting part extending along the longitudinal direction between, and interconnecting, the front and rear parts, the rear part having opposite surfaces and a first cutout extending through the opposite surfaces of the rear part;

b) a header having generally planar panel portions engaging the opposite surfaces of the rear part, and bearing information relating to the footwear, each panel portion having a second cutout of complementary contour to, and reinforcing, the first cutout for suspending the hanger on a support that extends through the cutouts; and c) a pair of holders in a side-by-side relationship on the front part, for holding the footwear for display.

2. The hanger of claim 1, wherein the rear part is generally planar, and wherein the first cutout is configured as a hook.

3. The hanger of claim 1, wherein the header is constituted of a single piece of sheet material that is folded to form the panel portions, and wherein the second cutout of each panel portion is configured as a hook.

4. The hanger of claim 1, wherein the holders are arranged in a mirror symmetrical relationship on the front part.

5. The hanger of claim 1; and further comprising a display area on the front part and located between the holders.

6. The hanger of claim 1, wherein the bracket includes a stiffening rib extending along the longitudinal direction between the front and rear parts, and wherein the header has a slit for receiving the rib.

7. The hanger of claim 1, wherein the bracket includes a strengthening fin extending at least partly along the rear part, and wherein the header has a slit for receiving the fin.

8. The hanger of claim 1, wherein the front part has a raised peripheral edge.

9. The hanger of claim 1, wherein each holder bounds a channel having an open upper end.

10. The hanger of claim 1, wherein each holder bounds a channel having an open side end.

11. The hanger of claim 1, wherein each holder has an arched frame for insertion into the footwear.

12. A point-of-sale hanger for footwear, comprising:

a) a bracket of synthetic plastic material and having a front part extending over a first distance along an upward direction, a rear part extending over a second distance longer than the first distance along the upward direction and spaced away from the front part along a longitudinal direction, and a connecting part extending along the longitudinal direction between, and interconnecting, the front and rear parts, the rear part having opposite surfaces and a first cutout extending through the opposite surfaces of the rear part, the front part having a central display area extending along a transverse direction generally perpendicular to the longitudinal direction;

b) a header having generally planar panel portions engaging the opposite surfaces of the rear part, and bearing information relating to the footwear, each panel portion having a second cutout of complementary contour to, and reinforcing, the first cutout for suspending the hanger on a support that extends through the cutouts, the header having a height substantially equal to the second distance along the upward direction, and a width greater than the central display area along the transverse direction; and c) a pair of holders in a mirror symmetrical relationship and situated at opposite sides of the central display area on the front part, for holding the footwear upright for display.

13. The hanger of claim 12; and further comprising an adhesive decal bearing data relating to the footwear, and adhered to the central display area.

14. The hanger of claim 12, wherein the bracket includes a stiffening rib extending along the longitudinal direction between the front and rear parts, and a strengthening fin extending at least partly along the upward direction along the rear part.

15. The hanger of claim 12, wherein each holder bounds a channel having a waist that constricts the channel, and past which a portion of the footwear is passed.

16. The hanger of claim 12, wherein each holder has a channel having an open upper end.

17. The hanger of claim 12, wherein each holder has a channel having an open side end.

18. The hanger of claim 12, wherein each holder has an arched frame for insertion into the footwear.

19. The hanger of claim 12, wherein the header is constituted of a folded, sheet material made of heavyweight paper.

20. The hanger of claim 12, wherein each cutout has a hook shape.

* * * * *